US012605581B2

(12) United States Patent
Bikko et al.

(10) Patent No.: US 12,605,581 B2
(45) Date of Patent: Apr. 21, 2026

(54) EXERCISE DEVICE

(71) Applicant: BreathCore, Inc., Orinda, CA (US)

(72) Inventors: Nirinjan Bikko, Orinda, CA (US); Tyler C. Grudowski, Chicago, IL (US)

(73) Assignee: BreathCore, Inc, Orinda, CA (US)

( * ) Notice: Subject to any disclaimer, the term of this patent is extended or adjusted under 35 U.S.C. 154(b) by 96 days.

(21) Appl. No.: 18/799,491

(22) Filed: Aug. 9, 2024

(65) Prior Publication Data

US 2024/0399189 A1 Dec. 5, 2024

Related U.S. Application Data

(63) Continuation-in-part of application No. 18/075,404, filed on Dec. 5, 2022, now Pat. No. 12,145,017.

(60) Provisional application No. 63/285,895, filed on Dec. 3, 2021.

(51) Int. Cl.

| | |
|---|---|
| ***A63B 21/04*** | (2006.01) |
| ***A63B 21/00*** | (2006.01) |
| ***A63B 21/02*** | (2006.01) |
| ***A63B 21/05*** | (2006.01) |
| ***A63B 21/055*** | (2006.01) |
| ***A63B 23/035*** | (2006.01) |
| ***A63B 23/12*** | (2006.01) |

(52) U.S. Cl.

CPC ..... *A63B 21/0428* (2013.01); *A63B 21/023* (2013.01); *A63B 21/05* (2013.01); *A63B 21/0557* (2013.01); *A63B 21/4035* (2015.10); *A63B 23/03533* (2013.01); *A63B 23/12* (2013.01)

(58) Field of Classification Search

CPC ... A63B 21/0428; A63B 21/023; A63B 21/05; A63B 21/0557; A63B 21/4035; A63B 23/03533; A63B 23/12; A63B 21/0552; A63B 21/00043

See application file for complete search history.

(56) References Cited

U.S. PATENT DOCUMENTS 1,023,756 A * 4/1912 Pons ..... A63B 21/05 482/126
3,003,764 A * 10/1961 Yovanovitch .... A63B 21/00043 482/49
3,132,861 A * 5/1964 Horney ..... A63B 21/0004 482/46

(Continued)

*Primary Examiner* — Andrew S Lo

(74) *Attorney, Agent, or Firm* — Mendelsohn Dunleavy, P.C.; Steve Mendelsohn

(57) ABSTRACT

An exercise device having an insert slidably coupled within a base; a compression element (e.g., a helical spring) located within a cavity formed by the base and the insert; an extension element (e.g., an elastic band) extending through the cavity; and opposing handles connected to opposing ends of the extension element. When the device is in its equilibrium state with no external longitudinal forces applied to the handles, the spring is slightly compressed and the elastic band is slightly extended with the resulting forces keeping the components of the device together. When the opposing handles are moved closer together, the elastic band is relaxed and the spring is further compressed. When the opposing handles are moved further apart, the elastic band is further extended, but the spring is not relaxed.

14 Claims, 18 Drawing Sheets

(56) References Cited

U.S. PATENT DOCUMENTS 3,268,225 A * 8/1966 Kolbel ..... A63B 21/00043 482/126
3,330,558 A 7/1967 Simons, Jr.
3,717,338 A * 2/1973 Hughes ..... A63B 23/14 482/46
4,111,417 A 9/1978 Gardner
4,211,404 A * 7/1980 Blowsky ..... A63B 21/00043 482/128
4,211,405 A * 7/1980 Blowsky ..... A63B 21/05 482/128
4,376,533 A * 3/1983 Kolbel ..... A63B 23/03525 482/125
4,651,985 A 3/1987 Salisbury
4,695,049 A * 9/1987 Ciemiega ..... A63B 23/14 482/46
4,856,776 A * 8/1989 Ching-Liang ..... A63B 21/045 482/122
5,046,726 A * 9/1991 Van Straaten ..... A63B 21/05 482/125
5,046,727 A * 9/1991 Wilkinson ..... A63B 21/015 428/909
5,154,685 A * 10/1992 Chen ..... A63B 21/00043 482/121
5,643,158 A * 7/1997 Clementi ..... A63B 21/00043 482/121
5,941,799 A * 8/1999 Bergdorf ..... A63B 21/0455 482/44
6,926,747 B2 8/2005 Udwin
7,175,575 B1 2/2007 Dantolen
8,777,821 B2 7/2014 Lando
10,039,950 B2 * 8/2018 Hao ..... A63B 22/20
10,220,237 B2 * 3/2019 Bentley ..... A63B 21/4035
10,695,604 B2 6/2020 Porterfield
10,974,087 B1 * 4/2021 Moon ..... A63B 23/1254
12,145,017 B2 * 11/2024 Bikko ..... A63B 23/03533
2002/0198081 A1 * 12/2002 Chen ..... A63B 21/00185 482/23
2004/0152571 A1 * 8/2004 Udwin ..... A63B 21/023 482/126
2009/0093349 A1 * 4/2009 Cooper ..... A63B 21/0004 482/106
2012/0077648 A1 * 3/2012 Farrow ..... A63B 21/4035 482/110
2013/0029811 A1 * 1/2013 Lando ..... A63B 21/05 482/121
2014/0162848 A1 * 6/2014 Fuller ..... A63B 22/20 482/72
2017/0080272 A1 * 3/2017 Bentley ..... A63B 21/00043
2019/0015696 A1 * 1/2019 Porterfield ..... A63B 21/4049

* cited by examiner

DETAIL C

EXERCISE DEVICE

CROSS-REFERENCE TO RELATED APPLICATIONS

This is a continuation-in-part of co-pending application Ser. No. 18/075,404, filed on Dec. 5, 2022, which claims the benefit of U.S. provisional patent application No. 63/285,895, filed on Dec. 3, 2021, the teachings of all of which are incorporated herein by reference in their entirety.

BACKGROUND

Field of the Disclosure

The present disclosure relates to exercise equipment.

Description of the Related Art

This section introduces aspects that may help facilitate a better understanding of the disclosure. Accordingly, the statements of this section are to be read in this light and are not to be understood as admissions about what is prior art or what is not prior art.

Pushing and pulling are functional movements of the human body that use reciprocal muscle activation and release. Reciprocal means opposing or inversely related. Reciprocal muscles of the human body refer to antagonists and stabilizers of an agonist or prime mover muscle or muscle group. Developing coordination, elasticity, and tone of reciprocal muscle groups during pulling and pushing supports efficient and healthy movements of the human body that are used in activities of everyday living, breathing, rehabilitation, and performance.

While many kinds of methods, systems, and apparatuses exist for muscle activation and release, such as free weights, weight-training equipment, spring-based equipment, tension bands, gravity-based equipment, there is no single method, system, and apparatus that can address activating and releasing opposing muscle(s) through pulling and pushing with resistance in the same movement plane without changing the body position in relationship to the equipment or the equipment itself. By changing the body position or the exercise equipment in between pulling and pushing, stored elastic energy dissipates, resulting in less coordination, muscle tone, and elasticity in the case of conventional exercise equipment.

SUMMARY

Problems in the prior art are addressed in accordance with the principles of the present disclosure by an exercise device having an insert slidably coupled within a base; a compression element (e.g., a helical spring) located within a cavity formed by the base and the insert; an extension element (e.g., an elastic band) extending through the cavity; and opposing handles connected to opposing ends of the extension element. When the device is in its equilibrium state with no external longitudinal forces applied to the handles, the spring is slightly compressed and the elastic band is slightly extended with the resulting forces keeping the components of the device together. When the opposing handles are moved closer together, the elastic band is relaxed and the spring is further compressed. When the opposing handles are moved further apart, the elastic band is further extended, but the spring is not totally relaxed.

In preferred embodiments, the exercise device is a light, portable, handheld fitness tool that combines respiratory and core muscle training to optimize breathing capacity, core strength, posture, and balance. The foundation of the exercise device lies in the sophisticated application of biomechanics and physiology. The exercise device leverages the principle of stored elastic energy, which refers to the potential energy stored in your muscles during one phase of movement and breath, and how this energy can be utilized to power the reciprocal or opposing muscle group and breath phase. This approach leverages the stored energy in your respiratory and core muscles to help build strength and resilience quickly and efficiently.

At the heart of the exercise device is its dual-resistance transfer function which harmonizes lengthening (pulling) and compressive (pushing) resistances so that the stored energy of each action, when released, is transferred to the opposing action (i.e., pulling to pushing and pushing to pulling). In order for this to take place, there is a ratio of pulling-to-pushing and pushing-to-pulling resistance with both extension and compression elements under a specified amount of tension in the exercise device's relaxed or neutral (i.e., equilibrium) position.

BRIEF DESCRIPTION OF THE DRAWINGS

Embodiments of the disclosure will become more fully apparent from the following detailed description, the appended claims, and the accompanying drawings in which like reference numerals identify similar or identical elements.

DETAILED DESCRIPTION

Detailed illustrative embodiments of the present disclosure are disclosed herein. However, specific structural and functional details disclosed herein are merely representative for purposes of describing example embodiments of the present disclosure. The present disclosure may be embodied in many alternate forms and should not be construed as limited to only the embodiments set forth herein. Further, the terminology used herein is for the purpose of describing particular embodiments only and is not intended to be limiting of example embodiments of the disclosure.

As used herein, the singular forms "a," "an," and "the," are intended to include the plural forms as well, unless the context clearly indicates otherwise. It further will be understood that the terms "comprises," "comprising," "contains," "containing," "includes," and/or "including," specify the presence of stated features, steps, or components, but do not preclude the presence or addition of one or more other features, steps, or components. It also should be noted that in some alternative implementations, the functions/acts noted may occur out of the order noted in the figures. For example, two figures shown in succession may in fact be executed substantially concurrently or may sometimes be executed in the reverse order, depending upon the functions/acts involved.

Figure 1A:
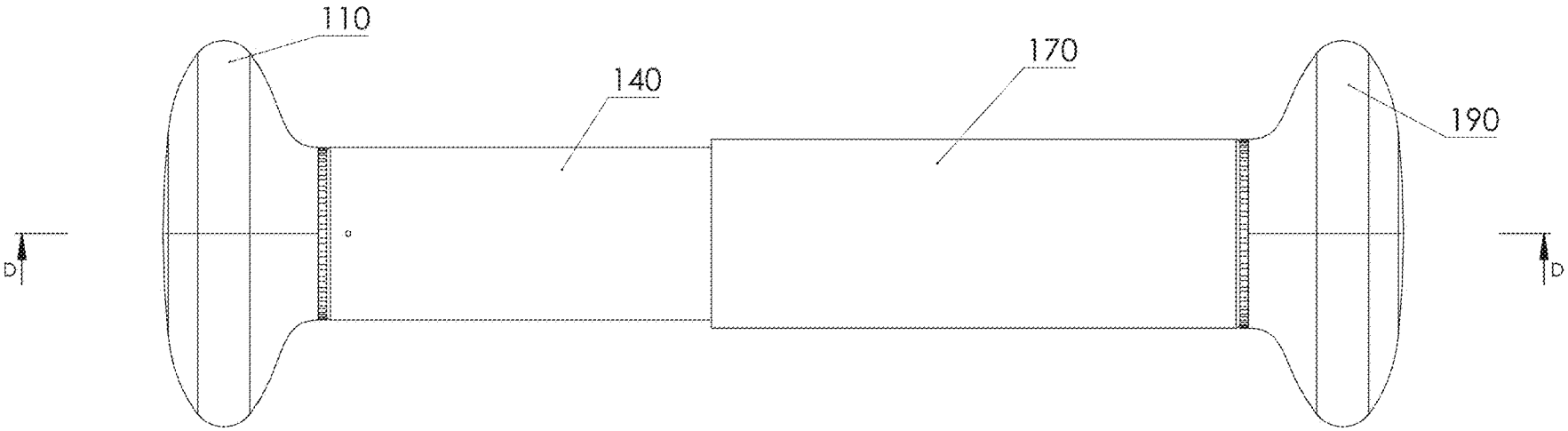
FIGS. 1A and 1B are side and cross-sectional, side views, respectively, of an exercise device in its equilibrium state, according to certain embodiments of the disclosure.
Figure 1B:
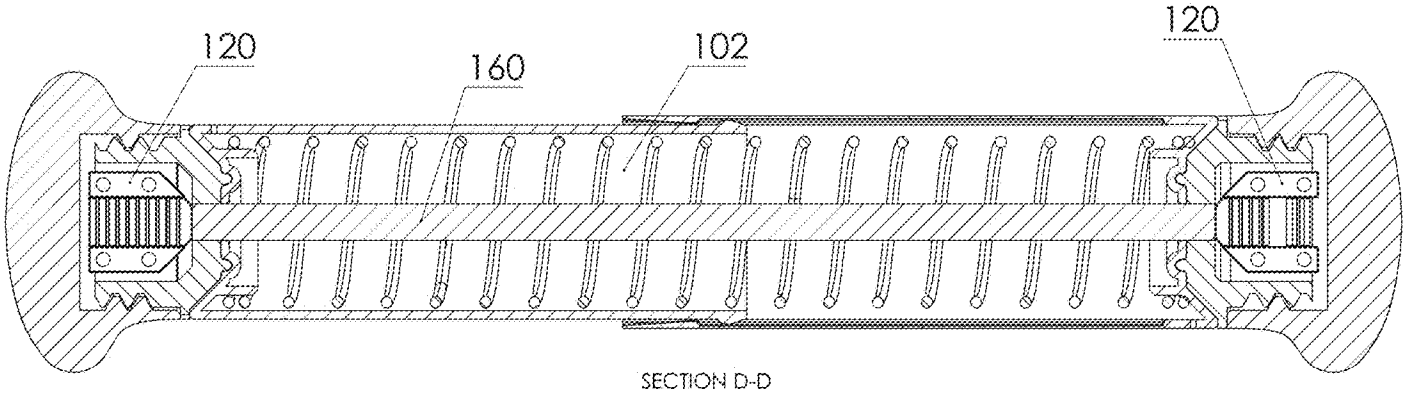
Figure 1C:
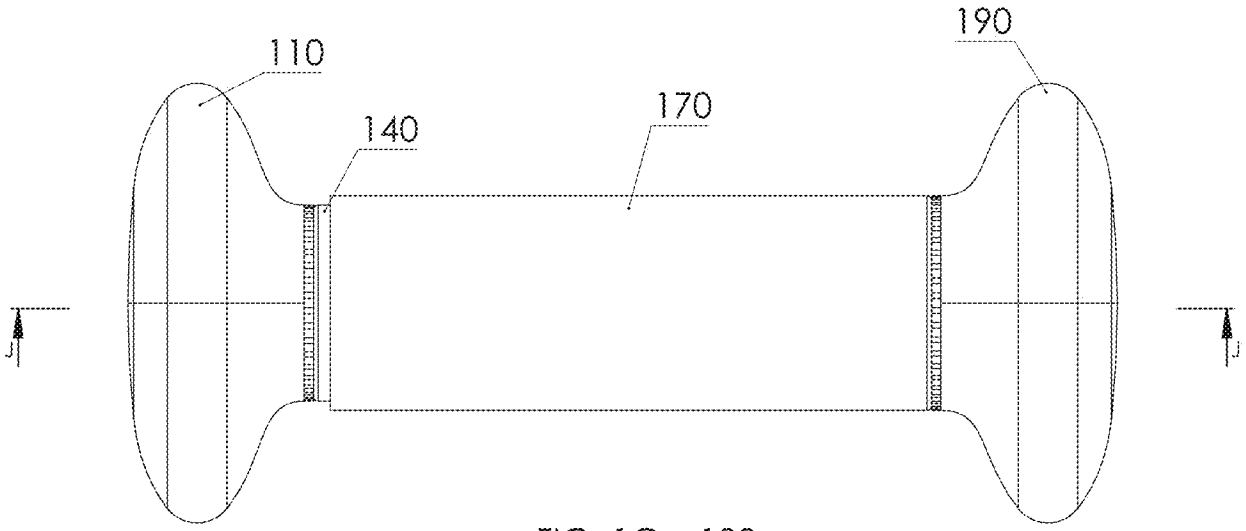
FIGS. 1C and 1D are side and cross-sectional, side views, respectively, of the exercise device of FIGS. 1A and 1B in its fully compressed state.
Figure 1D:
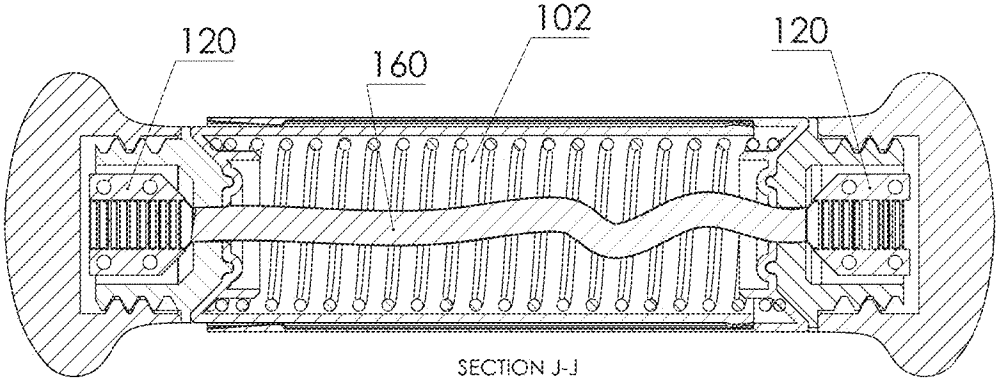
Figure 1E:
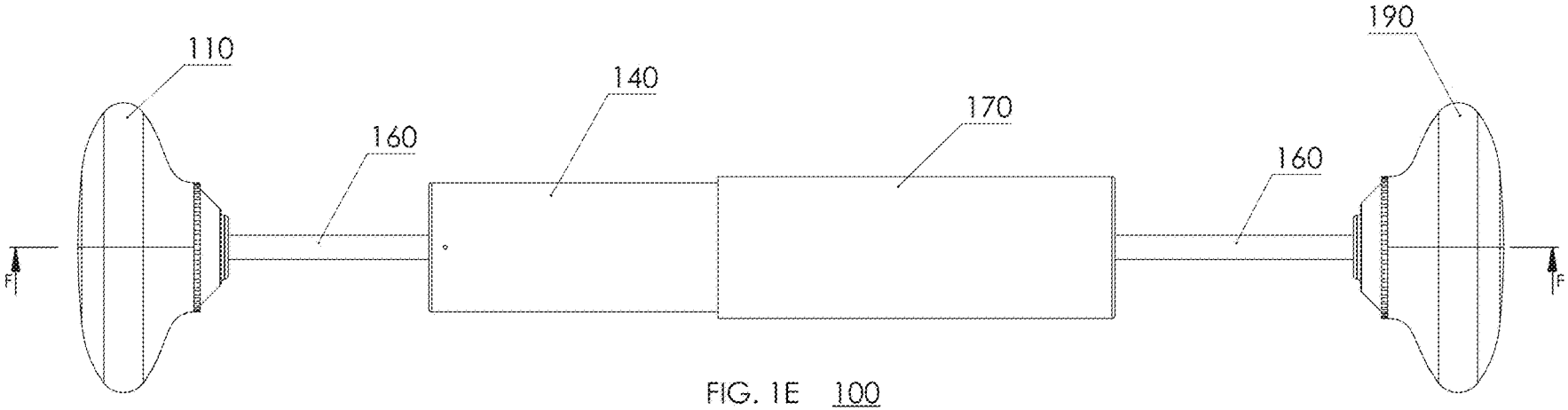
FIGS. 1E and 1F are side and cross-sectional, side views, respectively, of the exercise device of FIGS. 1A and 1B in an extended state.
Figure 1F:
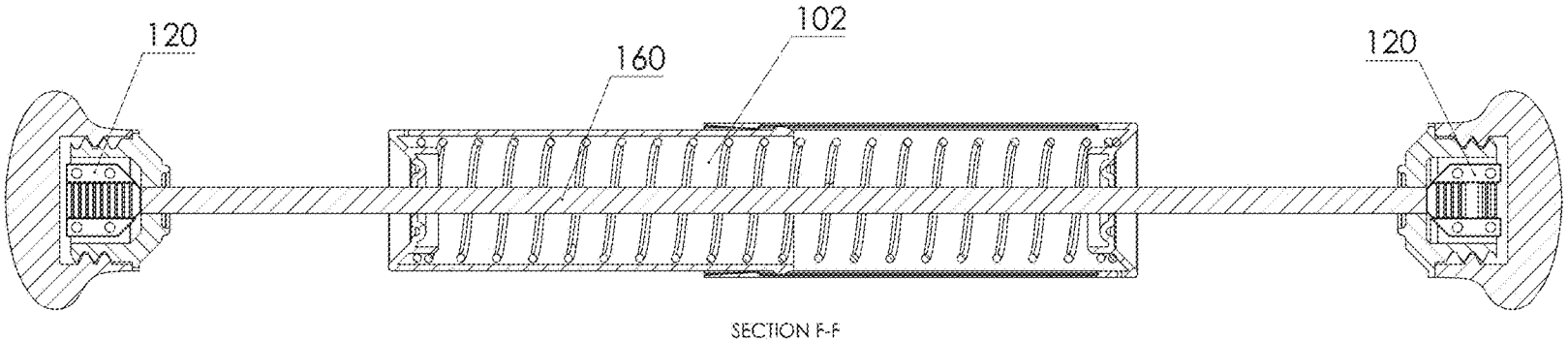
Figure 1G:
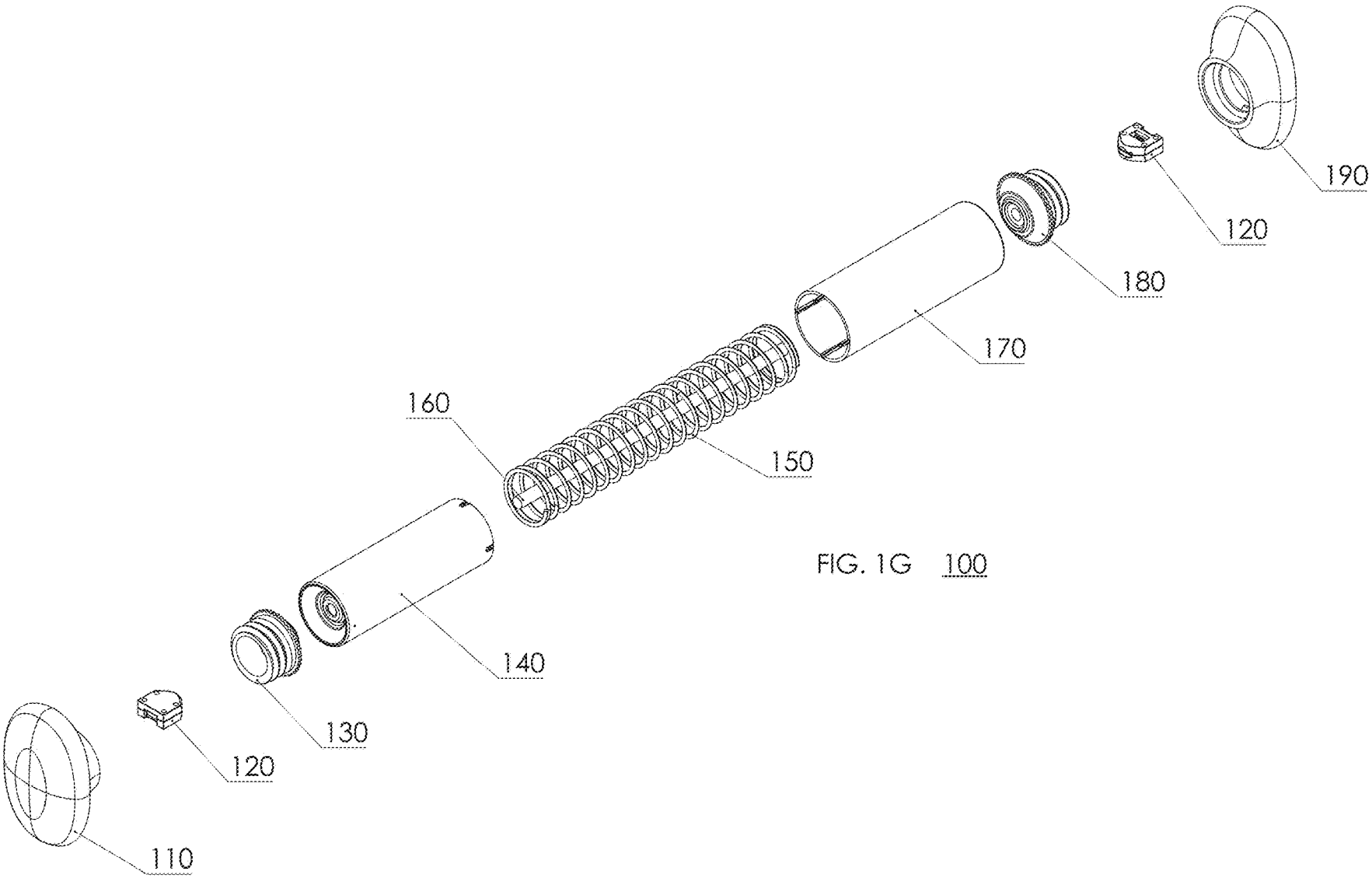
FIG. 1G is an exploded, perspective view of the exercise device of FIGS. 1A and 1B.
Figure 2B:
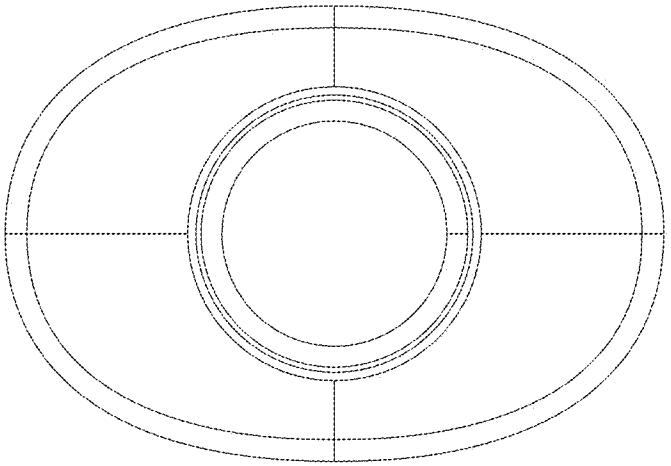
FIGS. 2A-2D show a perspective view, a bottom-up view, a side view, and a cross-sectional, end view, respectively, of the insert-side handle of FIGS. 1A-1G.
Figure 2D:
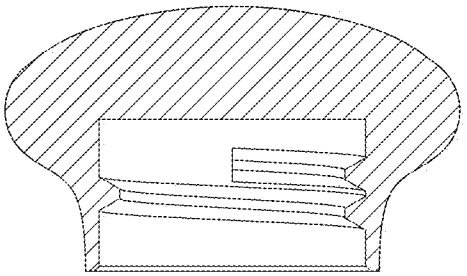
Figure 2A:
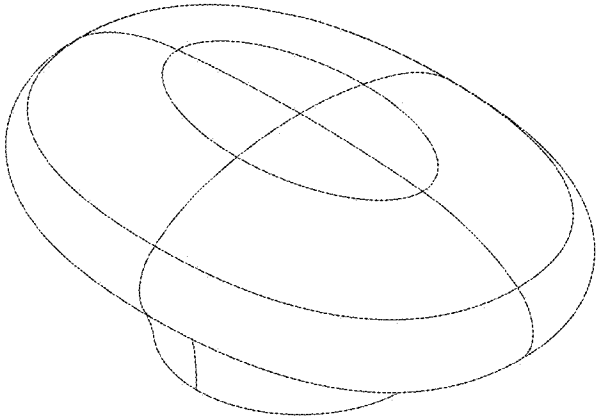
Figure 2C:
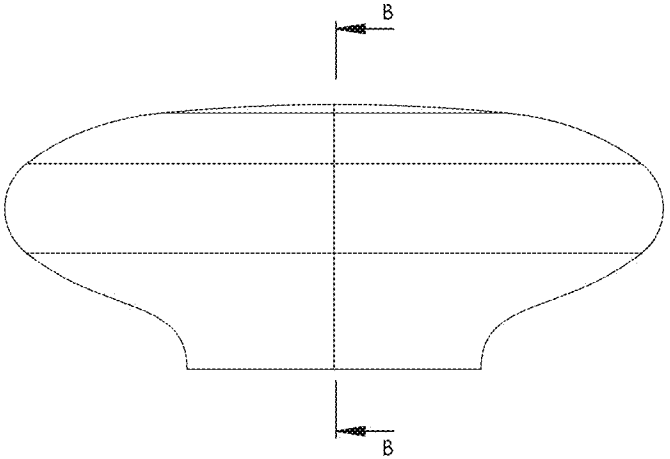

FIGS. 1A and 1B are side and cross-sectional, side views, respectively, of an exercise device 100 in its equilibrium state (i.e., with no external forces applied other than gravity), according to certain embodiments of the disclosure. FIGS. 1C and 1D are side and cross-sectional, side views, respectively, of the exercise device 100 of FIGS. 1A and 1B in its fully compressed state. FIGS. 1E and 1F are side and cross-sectional, side views, respectively, of the exercise device 100 of FIGS. 1A and 1B in an extended state. FIG. 1G is an exploded, perspective view of the exercise device 100 of FIGS. 1A and 1B.

Referring to FIG. 1G, the exercise device 100 includes an insert-side handle 110, a first (insert-side) crimp assembly 120, an insert-side collar 130, an insert 140, a compression element (e.g., a helical spring) 150, an extension element (e.g., an elastic band) 160, a base 170, a base-side collar 180, a second (base-side) crimp assembly 120, and a base-side handle 190.

As shown in the cross-sectional views of FIGS. 1B, 1D, and 1F:

- The insert-side handle 110 screws onto the insert-side collar 130;
- The first crimp assembly 120 is located within the insert-side collar 130 and is connected to the insert-side end of the elastic band 160;
- In the equilibrium or compressed state of the exercise device 100, the insert-side collar 130 abuts the corresponding end of the insert 140;
- The substantially cylindrical insert 140 is inserted into the substantially cylindrical base 170, which together form a variable-sized cavity 102 within which are located the elastic band 160 inside the spring 150;
- In the equilibrium or compressed state of the exercise device 100, the base-side collar 180 abuts the corresponding end of the base 170;
- The second crimp assembly 120 is located within the base-side collar 180 and is connected to the base-side end of the elastic band 160; and
- The base-side handle 190 screws onto the base-side collar 180.

The opposing ends of the elastic band 160 are rigidly connected to the crimp assemblies 120 located inside the insert-side and base-side collars 130 and 180, respectively. As described further below, the spring 150 resides within the cavity 102 formed by the insert 140 and the base 170 without being rigidly connected to either.

As described further below, the components of the exercise device 100 are specifically designed, such that, when the exercise device 100 is in its equilibrium state represented in FIGS. 1A and 1B (i.e., with no external translational forces applied to the handles 110 and 190), the spring 150 is partially compressed, and the elastic band 160 is partially extended, with the resulting outward force exerted by the spring 150 and the resulting inward force exerted by the elastic band 160 keeping the components of the exercise device 100 assembled.

When a person uses their hands to move the handles 110 and 190 closer together than in the equilibrium state of FIGS. 1A and 1B, as represented in FIGS. 1C and 1D, the elastic band 160 relaxes, while the spring 150 is further compressed. As the spring is released, it provides an opposing, restoring, outward force between the person's hands and energy is transferred to the opposing muscle group and breath phase. This provides more muscle energy to pull and breathe in. On the other hand, when a person uses their hands to move the handles 110 and 190 further apart than in the equilibrium state of FIGS. 1A and 1B, as represented in FIGS. 1E and 1F, the spring 150 remains in its partially compressed state within the cavity 102 formed by the insert 140 and the base 170, while the elastic band 160 extends to provide an opposing, restoring, inward force between the person's hands. When the elastic band is released, stored elastic energy is transferred to the opposing muscle group and breath phase. This provides more muscle energy to push and breathe out.

Note that, in the compressed state of FIG. 1D, the cavity 102 is smaller than the cavity 102 in the equilibrium state of FIG. 1B, while the cavity 102 in the expanded state of FIG. 1F has the same size as the cavity 102 in the equilibrium state of FIG. 1B.

FIGS. 2A-2D show a perspective view, a bottom-up view, a side view, and a cross-sectional, end view, respectively, of the insert-side handle 110 of FIGS. 1A-1G. The ergonomic handle 110 is designed to optimize the alignment of the user's hand and wrist to provide maximum comfort and efficiency during use. The centering of the handle 110 in the three arches of the hand provides stability and control, allowing for smooth and seamless movements without the need to readjust hand or wrist position. Additionally, the construction of the handle 110 is specifically engineered to optimize the transfer of energy from pulling to pushing, and vice versa. Whether the user has large hands or small hands, the handle 110 is versatile and accommodating, providing a comfortable grip for users of all sizes.

Figure 3B:
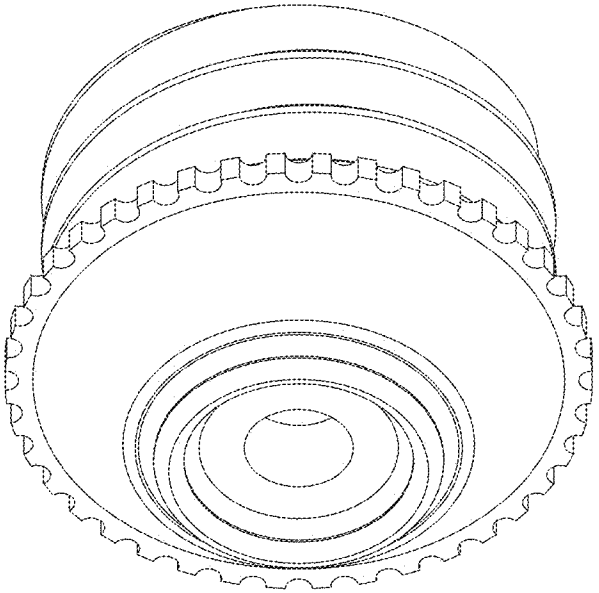
FIGS. 3A and 3B show different perspective views of the insert-side collar of FIGS. 1A-1G.
Figure 3A:
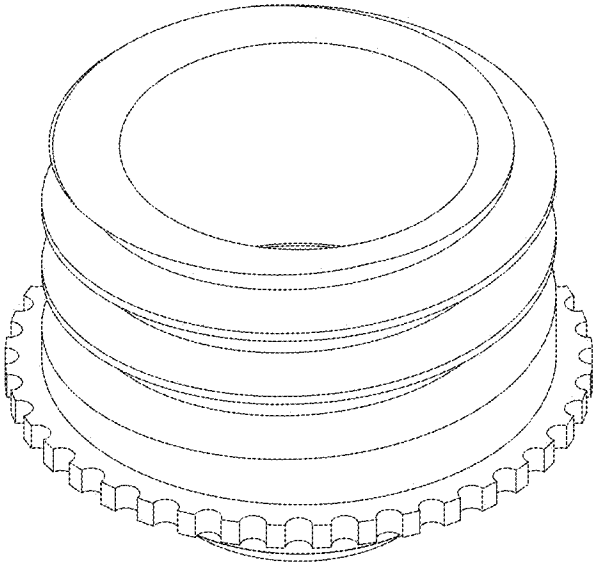
Figure 3C:
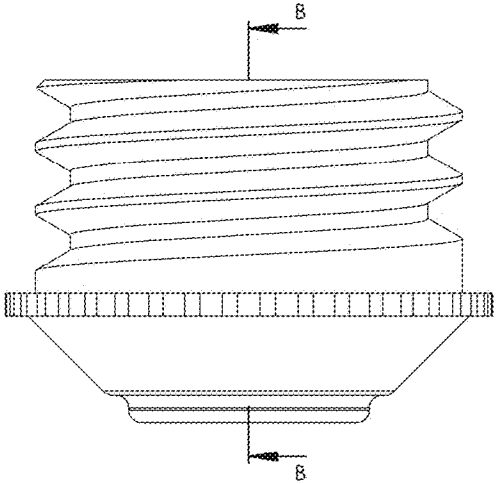
FIGS. 3C and 3D show side and cross-sectional, side views, respectively, of the insert-side collar of FIGS. 1A-1G.
Figure 3D:
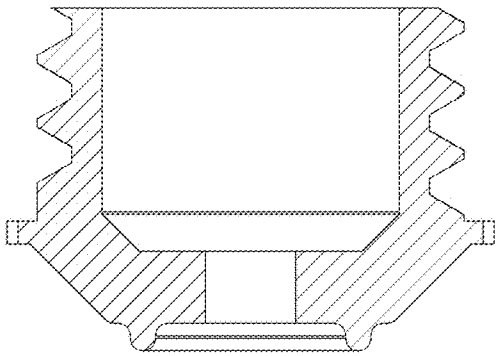
Figure 3E:
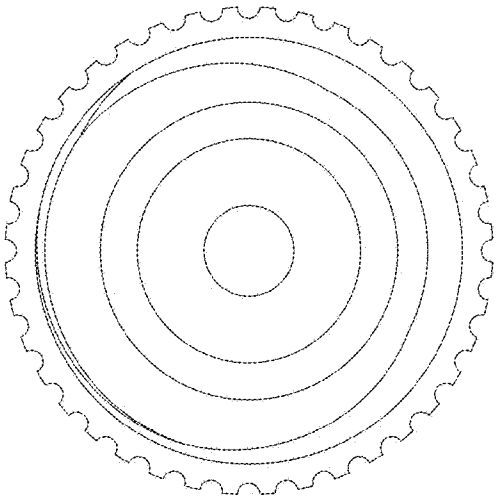
FIGS. 3E and 3F show opposing end views of the insert-side collar of FIGS. 1A-1G.
Figure 3F:
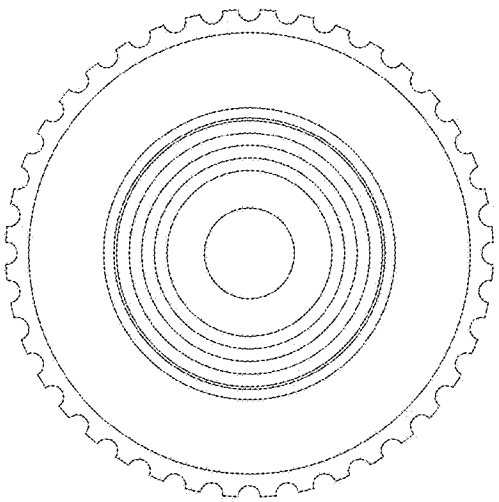

FIGS. 3A and 3B show different perspective views of the insert-side collar 130 of FIGS. 1A-1G; FIGS. 3C and 3D show side and cross-sectional, side views, respectively, of the insert-side collar 130 of FIGS. 1A-1G; and FIGS. 3E and 3F show opposing end views of the insert-side collar 130 of FIGS. 1A-1G.

Figure 4B:
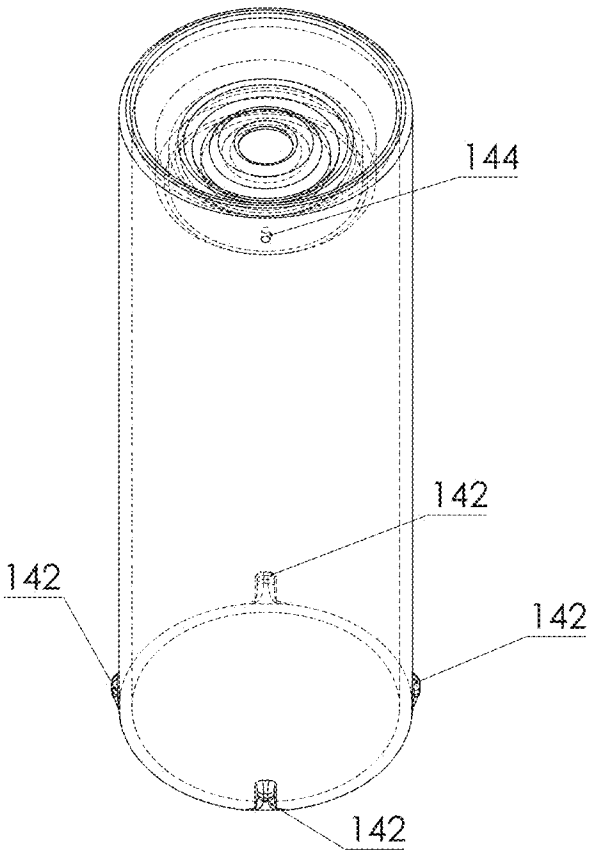
FIGS. 4A and 4B show perspective and perspective, X-ray views, respectively, of the insert of FIGS. 1A-1G.
Figure 4A:
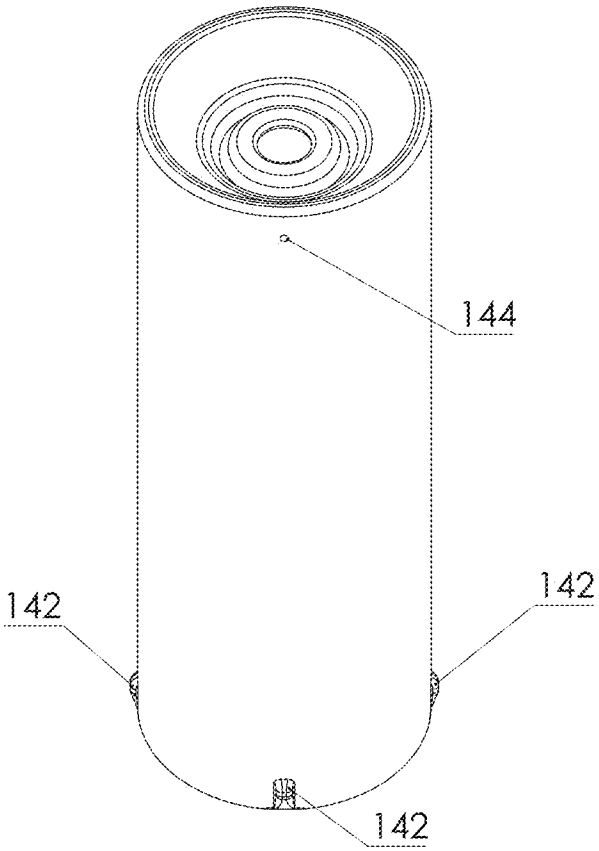
Figure 4D:
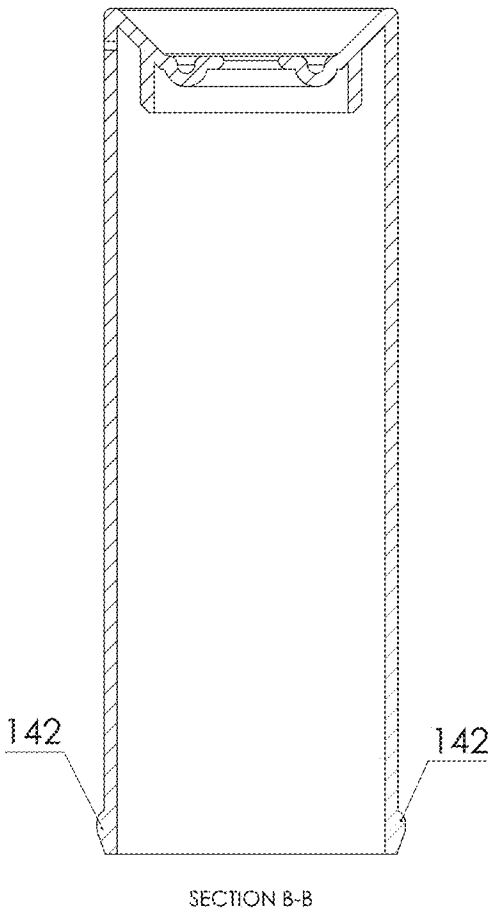
FIGS. 4C and 4D show side and cross-sectional, side views, respectively, of the insert of FIGS. 1A-1G.
Figure 4C:
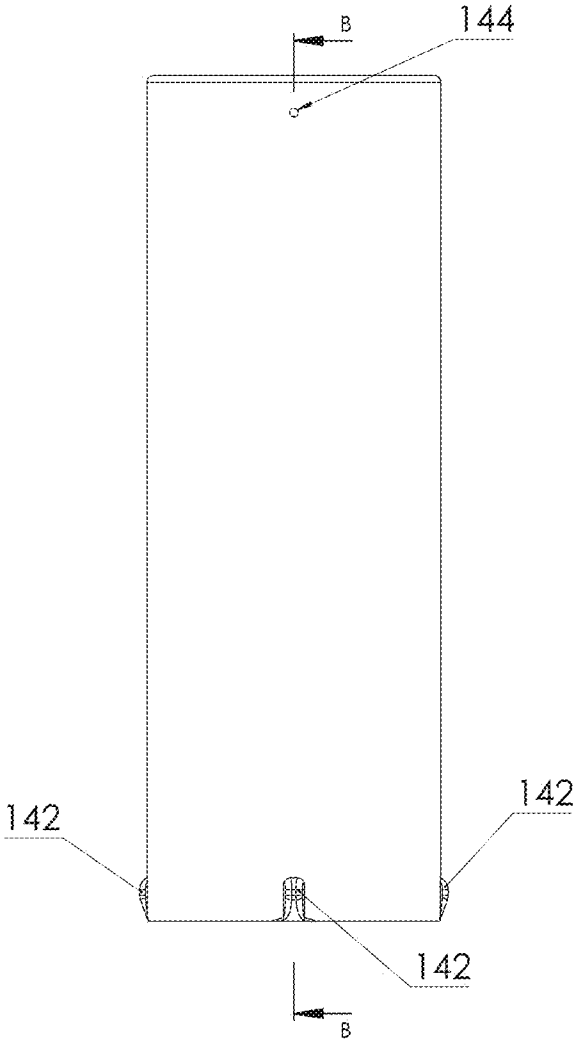
Figure 4F:
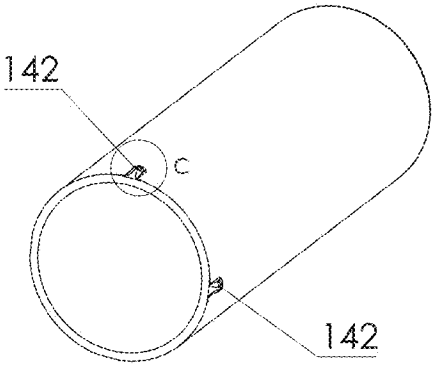
FIG. 4F shows a perspective view of the insert of FIGS. 1A-1G.
Figure 4G:
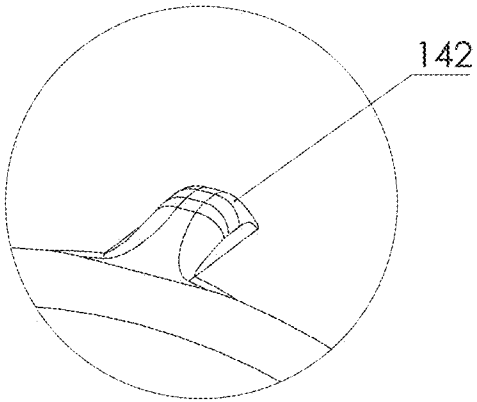
FIG. 4G shows an enlarged view of a portion of the perspective view of FIG. 4F of the insert of FIGS. 1A-1G.
Figure 4E:
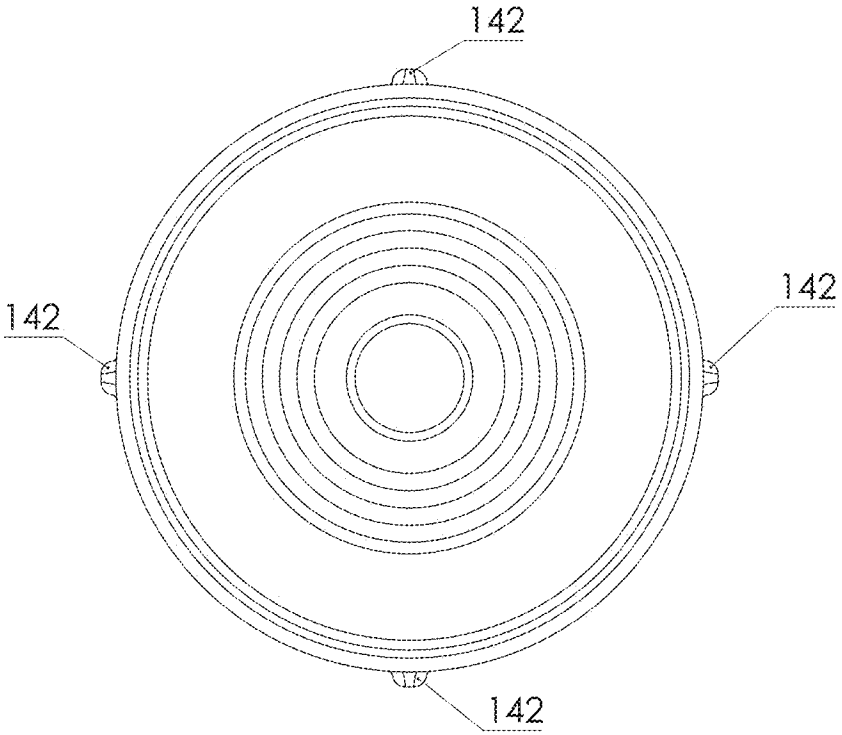
FIG. 4E shows an end view of the insert of FIGS. 1A-1G.

FIGS. 4A and 4B show perspective and perspective, X-ray views, respectively, of the insert 140 of FIGS. 1A-1G; FIGS. 4C and 4D show side and cross-sectional, side views, respectively, of the insert 140 of FIGS. 1A-1G; FIG. 4E shows an end view of the insert 140 of FIGS. 1A-1G; and FIG. 4G shows an enlarged view of a portion of the perspective view of FIG. 4F of the insert 140 of FIGS. 1A-1G. As shown in FIGS. 4A-4G, the outer surface of the insert 140 has four keys 142, which are described further below. As shown in FIGS. 4A-4C, the insert 140 also has an airhole 144 that allows air to flow out of and then into the cavity 102 when the exercise device 100 is compressed and then decompressed.

Figure 5B:
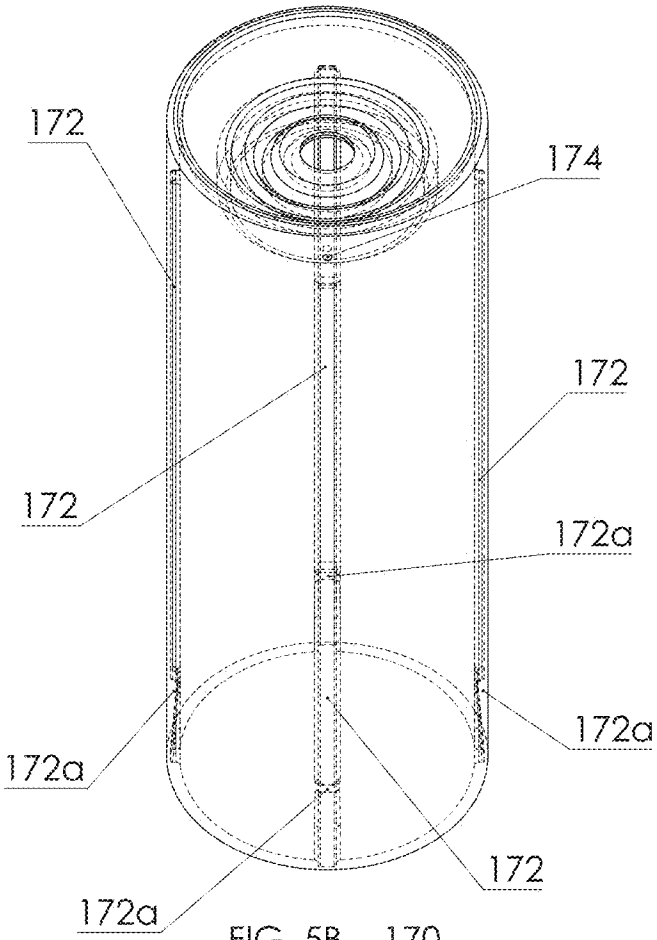
FIGS. 5A and 5B show perspective and perspective, X-ray views, respectively, of the base of FIGS. 1A-1G.
Figure 5A:
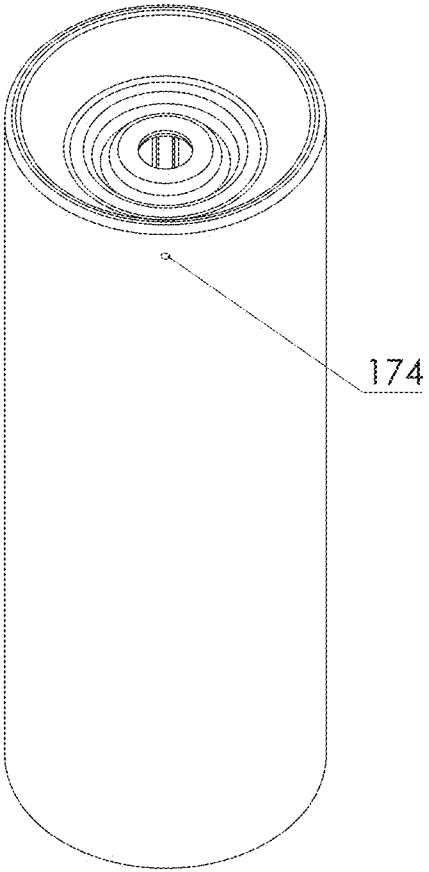
Figure 5D:
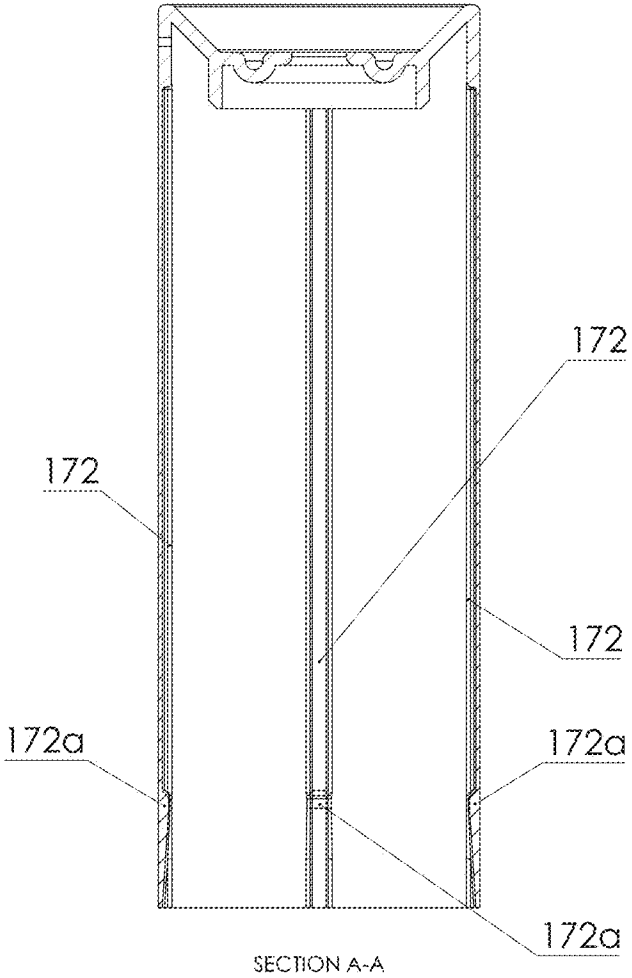
FIGS. 5C and 5D show side and cross-sectional, side views, respectively, of the base of FIGS. 1A-1G.
Figure 5C:
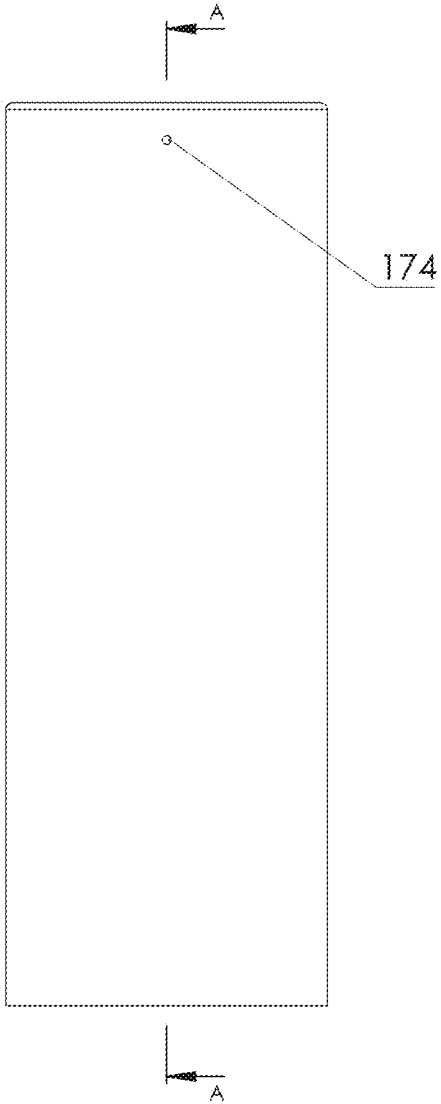
Figure 5F:
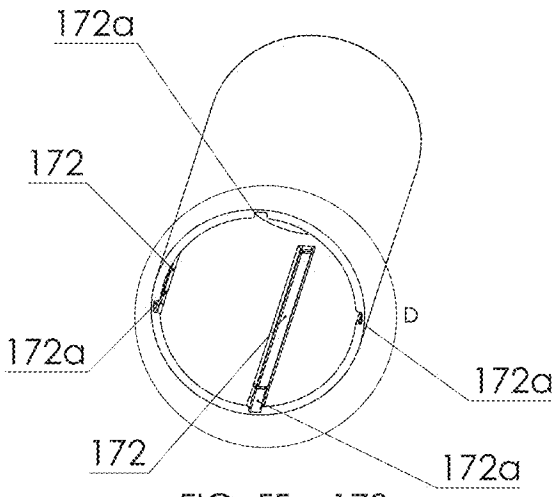
FIG. 5F shows a perspective view of the base of FIGS. 1A-1G.
Figure 5G:
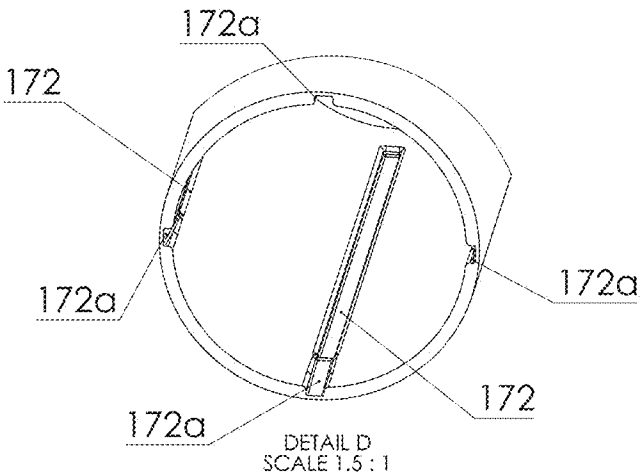
FIG. 5G shows an enlarged view of a portion of the perspective view of FIG. 5F of the base of FIGS. 1A-1G.
Figure 5E:
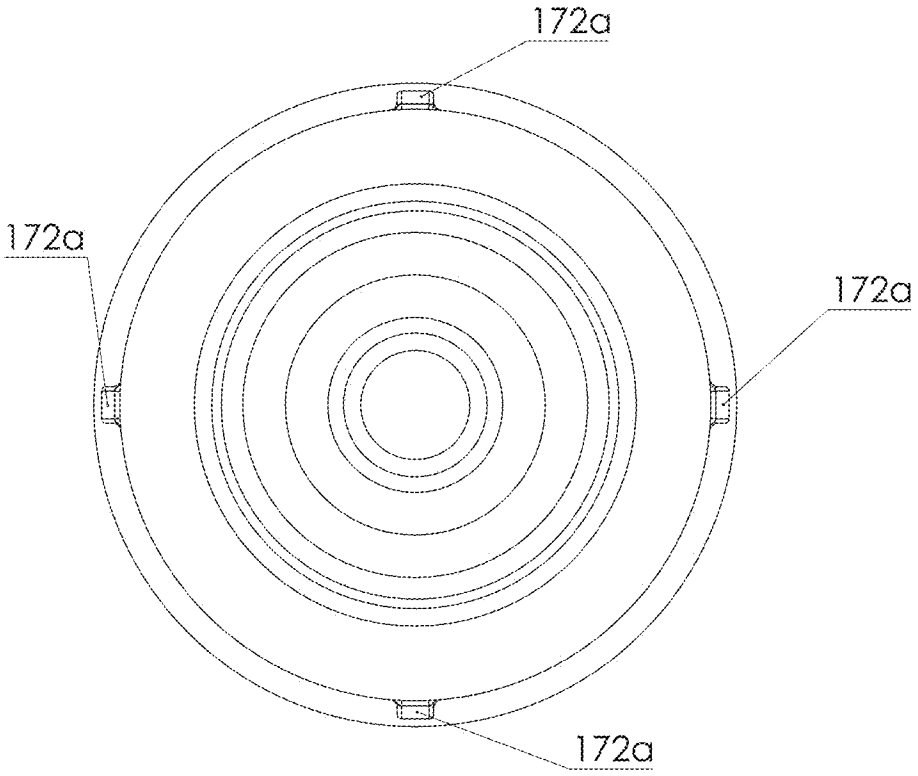
FIG. 5E shows an end view of the base of FIGS. 1A-1G.

FIGS. 5A and 5B show perspective and perspective, X-ray views, respectively, of the base 170 of FIGS. 1A-1G; FIGS. 5C and 5D show side and cross-sectional, side views, respectively, of the base 170 of FIGS. 1A-1G; FIG. 5E shows an end view of the base 170 of FIGS. 1A-1G; and FIG. 5G shows an enlarged view of a portion of the perspective view of FIG. 5F of the base 170 of FIGS. 1A-1G.

As shown in FIGS. 5A-5G, the inner surface of base 170 has four keyways 172 that are designed to receive the four keys 142 of the insert 140. In particular, each keyway 172 is a longitudinal groove having a detent 172*a* at the proximal end of the base 170.

With the spring 150 positioned within the open end of either the insert 140 or the base 170, the insert 140 and the base 170 are connected by inserting the four keys 142 of the insert 140 into the four keyways 172 of the base 170 and forcing the keys 142 past the detents 172*a*, thereby compressing the spring 150 and enabling the keys 142 to slide along the keyways' longitudinal grooves as the spring 150 is further compressed. In both the equilibrium state of FIGS. 1A-1B and the extended state of FIGS. 1E-1F, the slightly compressed spring 150 exerts an outward force that presses the keys 142 against the detents 172*a*, thereby holding the insert 140 and the base 170 together. Note that the sub-assembly consisting of the spring 150 located within the cavity 102 formed by the insert 140 and the base 170 can be disassembled by reversing the just-described assembly process.

As shown in FIGS. 5A-5C, the base 170 also has an airhole 174 that allows air to flow out of and then into the cavity 102 when the exercise device 100 is compressed and then decompressed.

Figure 6B:
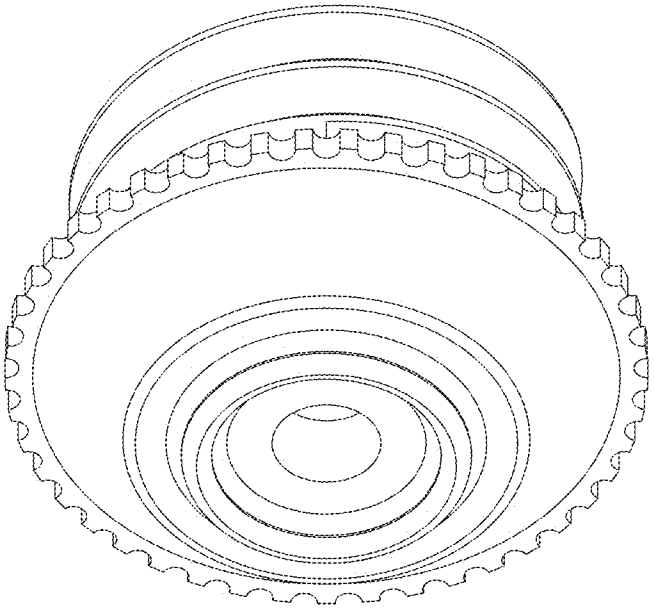
FIGS. 6A and 6B show different perspective views of the base-side collar of FIGS. 1A-1G.
Figure 6A:
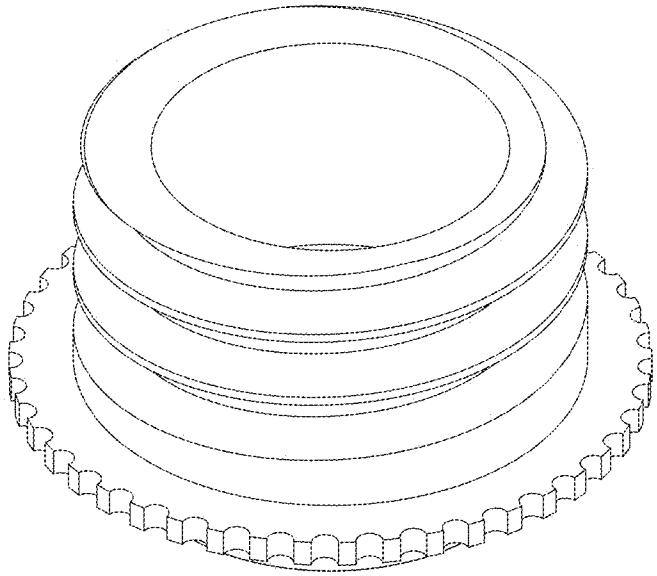
Figure 6D:
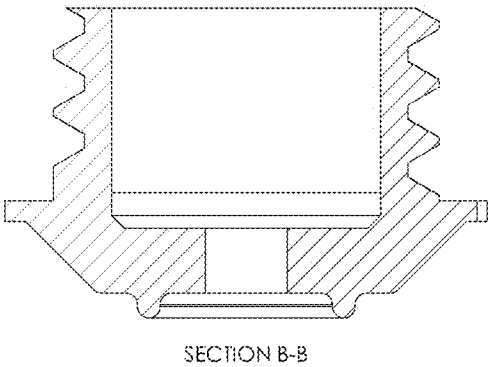
FIGS. 6C and 6D show side and cross-sectional side views, respectively, of the base-side collar of FIGS. 1A-1G.
Figure 6F:
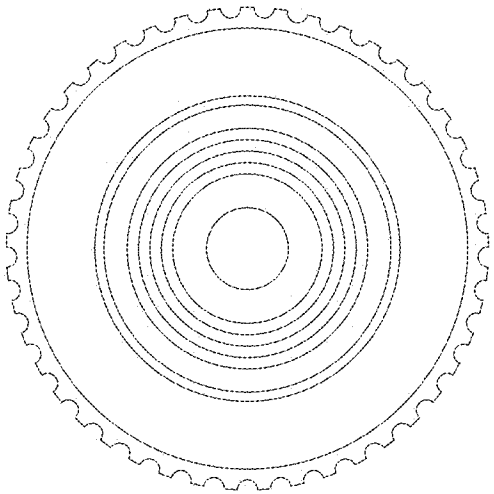
FIGS. 6E and 6F show opposing end views of the base-side collar of FIGS. 1A-1G.
Figure 6C:
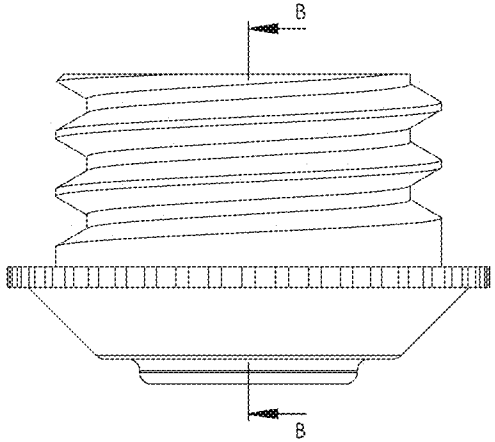
Figure 6E:
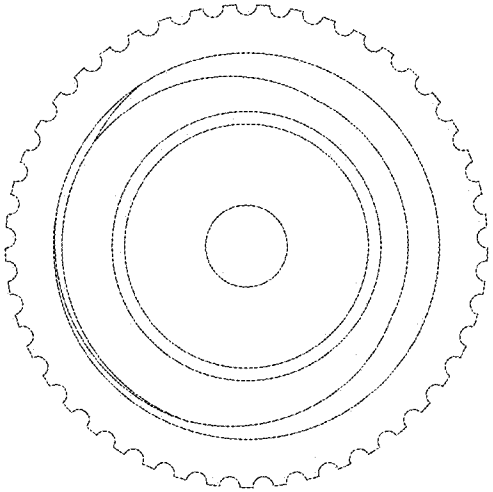
Figure 7B:
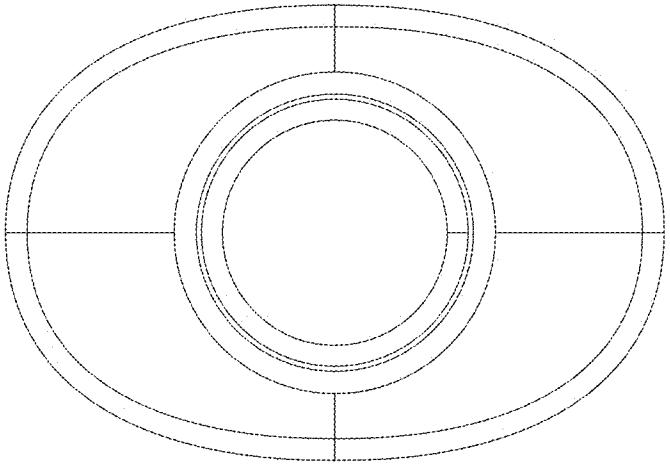
FIGS. 7A-7D show a perspective view, a bottom up view, a side view, and a cross-sectional end view, respectively, of the base-side handle of FIGS. 1A-1G.
Figure 7D:
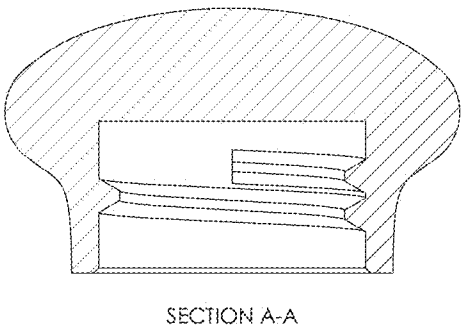
Figure 7A:
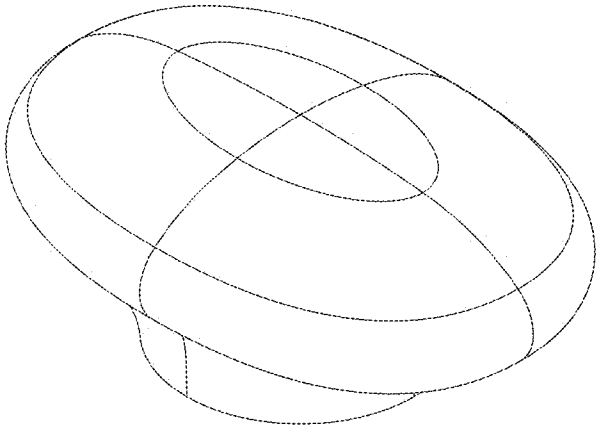
Figure 7C:
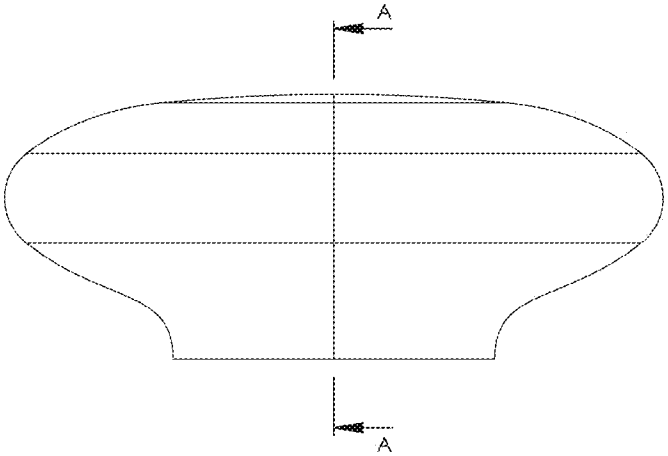

FIGS. 6A and 6B show different perspective views of the base-side collar 180 of FIGS. 1A-1G; FIGS. 6C and 6D show side and cross-sectional side views, respectively, of the base-side collar 180 of FIGS. 1A-1G; and FIGS. 6E and 6F show opposing end views of the base-side collar 180 of FIGS. 1A-1G FIGS. 7A-7D show a perspective view, a bottom up view, a side view, and a cross-sectional end view, respectively, of the base-side handle 190 of FIGS. 1A-1G. The base-side handle 190 is similar to the insert-side handle 110 described previously.

Figure 8C:
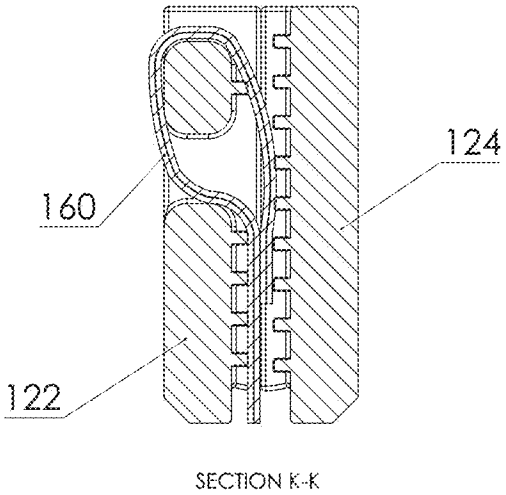
FIGS. 8A-8C show a perspective view, a plan view, and a cross-sectional, side view, respectively, of each crimp assembly of FIGS. 1A-1G.
Figure 8B:
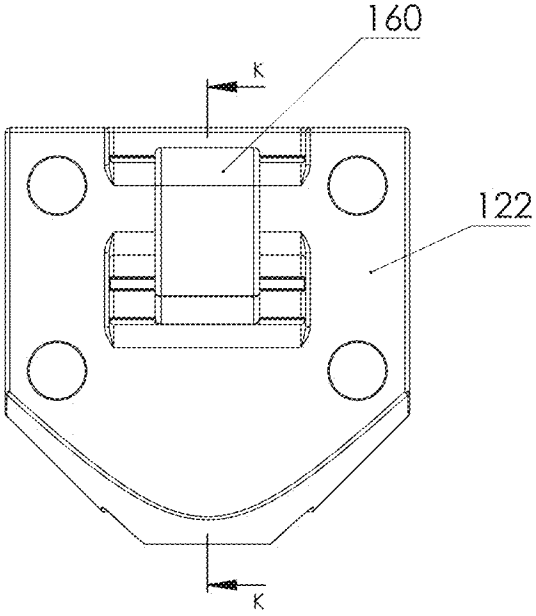
Figure 8A:
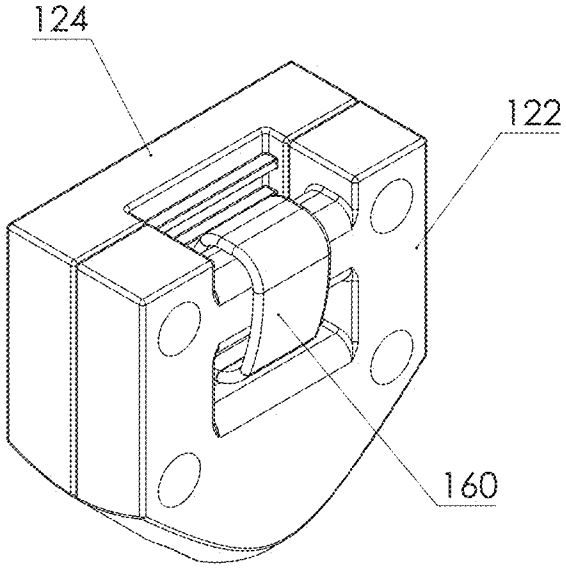
Figure 8E:
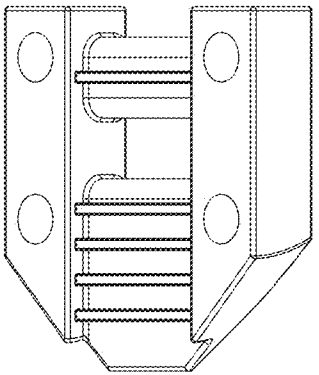
FIGS. 8D and 8E show a plan view and a perspective view, respectively, of the female crimp element of FIGS. 8A-8C.
Figure 8G:
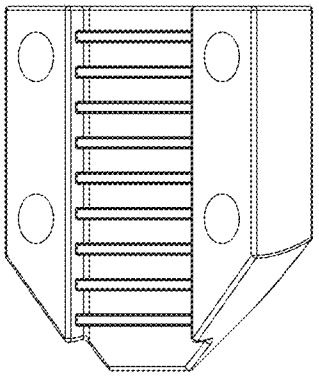
FIGS. 8F and 8G show a plan view and a perspective view, respectively, of the male crimp element of FIGS. 8A-8C.
Figure 8D:
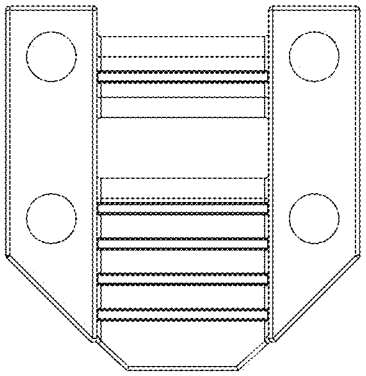
Figure 8F:
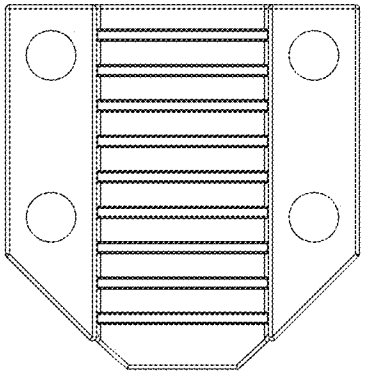

FIGS. 8A-8C show a perspective view, a plan view, and a cross-sectional, side view, respectively, of each crimp assembly 120 of FIGS. 1A-1G consisting of a female crimp element 122, a male crimp element 124, and four screws (not shown) used to secure the female crimp element 122 to the male crimp element 124. FIGS. 8D and 8E show a plan view and a perspective view, respectively, of the female crimp element 122 of FIGS. 8A-8C, while FIGS. 8F and 8G show a plan view and a perspective view, respectively, of the male crimp element 124 of FIGS. 8A-8C. As shown in FIGS. 8A-8C, the female and male crimp elements 122 and 124 secure one end of the elastic band 160 of FIGS. 1B, 1D, 1F, and 1G. Note that, in the implementation of FIGS. 8A-8C, the elastic band 160 is depicted as a flat band, while the elastic band 160 is depicted as a cylindrical band in the alternative implementation of FIG. 1G, due to deformation of the band when put in tension while wrapped around the crimp elements.

When a person uses their hands to move the handles 110 and 190 closer together than in the equilibrium state of FIGS. 1A and 1B (as represented in FIG. 1D), the insert's keys 142 slide within the base's third grooves 172*c*, the elastic band 160 relaxes, and the spring 150 is further compressed, thereby providing outward resistance to the forces applied by the person's hands. On the other hand, when a person uses their hands to move the handles 110 and 190 further apart than in the equilibrium state of FIGS. 1A and 1B (as represented in FIG. 1F), the elastic band 160 is further extended, while the sub-assembly of the insert 140, the spring 150, and the base 170 is not changed, thereby providing inward resistance to the forces applied by the person's hands.

The exercise device 100 of FIGS. 1A-1G has a pair of handles 110/190 having a particular size and shape. In some implementations, the exercise device 100 can be provisioned with two or more different sets of handles 110/190 of different sizes and/or different shapes, where each handle can be attached or detached from the exercise device based on the threaded engagement with a corresponding insert 120.

In one embodiment of the exercise device 100 of FIGS. 1A-1G:

- The spring 150 is a custom-made helical spring made of wound stainless steel;
- The eight screws (not shown) used to secure the female crimp element 122 to the male crimp element 124 are made of stainless steel;
- The elastic band 160 is made of latex resistance tubing from Theraband of Akron, Ohio; and
- The remaining components are made of injection-molded Acrylonitrile Butadiene Styrene (ABS) plastic.

Embodiments of the exercise device 100 may provide one or more of the following benefits and/or features:

- Increased Breathing Capacity and Flow: Users experience improved ease and depth in breathing;
- Stronger Core: Fast and effective core muscle development for overall body strength and stability;
- Improved Posture: Enhanced alignment and balance for improved workout, yoga, Pilates, sports, and daily movements;
- Greater Physical and Mental Balance: Achieve a sense of harmony and focus;
- Lightweight & Portable: Convenient for use at home, office, travel, gym, or studio;

Versatile Workouts: Offers a variety of exercises for standing, sitting, or lying down;

Easy to Use: Intuitive design suitable for beginners and advanced users; and

Ideal for Recovery: Perfect for rehabilitation and regaining strength and flexibility post-injury or illness.

The exercise device 100, a portable, handheld, fitness tool that combines respiratory and core training, is positioned to serve a unique niche within the broader fitness and health market. The exercise device 100 targets a cross-section of users interested in enhancing their breathing capacity, core strength, and resilience through a unified approach. The following are potential markets for the exercise device 100:

Yoga and Pilates Practitioners: The exercise device 100 provides an additional tool for practitioners looking to enhance their breath control and core strength in their practices. It offers a convenient way to deepen and optimize their practice at home or on the go;

Fitness Enthusiasts, Athletes, and Dancers: Athletes looking to improve their performance through enhanced respiratory efficiency and core stability can benefit from the exercise device 100. Fitness enthusiasts and dancers seeking to add a new dimension to their workouts can also benefit from this device;

Health and Wellness Market: Individuals with respiratory conditions seeking to improve lung capacity and breathing efficiency, older adults looking to maintain or improve respiratory and core muscle strength, and those interested in holistic health approaches could find value in the exercise device 100;

Rehabilitation and Physical Therapy: Postoperative patients and individuals rehabilitating from injuries that require core strengthening and respiratory training can use the exercise device 100 to aid in their recovery process; and Corporate Wellness Programs: Companies focused on improving employee health and well-being can incorporate the exercise device 100 into their wellness programs to enhance energy, focus, and reduce stress among employees, potentially increasing productivity.

Overall, the exercise device 100 caters to a diverse group of individuals seeking to improve their respiratory efficiency, core strength, and overall well-being.

In certain embodiments, the present disclosure is an exercise device (e.g., 100) comprising a base (e.g., 170); an insert (e.g., 140) slidably coupled within the base; a compression element (e.g., 150) located within a cavity (e.g., 102) formed by the base and the insert; an extension element (e.g., 160) extending through the cavity; and opposing handles (e.g., 110/190) connected to opposing ends of the extension element. The compression element is compressed when the opposing handles are moved closer together, and the extension element is extended when the opposing handles are moved further apart.

In at least some of the above embodiments, the compression element comprises a helical spring; and the extension element comprises an elastic band.

In at least some of the above embodiments, in an equilibrium state of the device with no external longitudinal forces applied to the handles, the compression element is partially compressed and the extension element is partially extended.

In at least some of the above embodiments, (i) opposing ends of the extension element are connected to the handles, but (ii) opposing ends of the compression element are not connected to the handles, such that (1) when the handles are moved farther apart from the device's equilibrium state, the extension element is further extended, but the compression element is not relaxed and (2) when the handles are moved closer together from the device's equilibrium state, the extension element is relaxed and the compression element is further compressed.

In at least some of the above embodiments, the insert has one or more keys that engage one or more keyways of the base such that, when the one or more keys are fully engaged within the one or more keyways, the compression element is partially compressed to exert outward translational forces to the insert and the base that keep the insert and the base interconnected when no external translational forces are applied to the insert and the base.

In at least some of the above embodiments, opposing ends of the extension element are connected to the handles by crimp assemblies (e.g., 120) located between the handle and a corresponding collar (e.g., 130/180).

In at least some of the above embodiments, each crimp assembly comprises a female crimp element (e.g., 122) that mates with a male crimp element (e.g., 124) to secure the corresponding end of the extension element.

In at least some of the above embodiments, the handles are replaceable by other handles of different size and/or shape.

Unless explicitly stated otherwise, each numerical value and range should be interpreted as being approximate as if the word "about" or "approximately" preceded the value or range.

The use of figure numbers and/or figure reference labels in the claims is intended to identify one or more possible embodiments of the claimed subject matter in order to facilitate the interpretation of the claims. Such use is not to be construed as necessarily limiting the scope of those claims to the embodiments shown in the corresponding figures.

Reference herein to "one embodiment" or "an embodiment" means that a particular feature, structure, or characteristic described in connection with the embodiment can be included in at least one embodiment of the disclosure. The appearances of the phrase "in one embodiment" in various places in the specification are not necessarily all referring to the same embodiment, nor are separate or alternative embodiments necessarily mutually exclusive of other embodiments. The same applies to the term "implementation."

Unless otherwise specified herein, the use of the ordinal adjectives "first," "second," "third," etc., to refer to an object of a plurality of like objects merely indicates that different instances of such like objects are being referred to, and is not intended to imply that the like objects so referred-to have to be in a corresponding order or sequence, either temporally, spatially, in ranking, or in any other manner.

Also for purposes of this description, the terms "couple," "coupling," "coupled," "connect," "connecting," or "connected" refer to any manner known in the art or later developed in which energy is allowed to be transferred between two or more elements, and the interposition of one or more additional elements is contemplated, although not required. Conversely, the terms "directly coupled," "directly connected," etc., imply the absence of such additional elements. The same type of distinction applies to the use of terms "attached" and "directly attached," as applied to a description of a physical structure. For example, a relatively thin layer of adhesive or other suitable binder can be used to implement such "direct attachment" of the two corresponding components in such physical structure.

The described embodiments are to be considered in all respects as only illustrative and not restrictive. In particular, the scope of the disclosure is indicated by the appended claims rather than by the description and figures herein. All changes that come within the meaning and range of equivalency of the claims are to be embraced within their scope.

In this specification including any claims, the term "each" may be used to refer to one or more specified characteristics of a plurality of previously recited elements or steps. When used with the open-ended term "comprising," the recitation of the term "each" does not exclude additional, unrecited elements or steps. Thus, it will be understood that an apparatus may have additional, unrecited elements and a method may have additional, unrecited steps, where the additional, unrecited elements or steps do not have the one or more specified characteristics.

As used herein, "at least one of the following: <a list of two or more elements>" and "at least one of <a list of two or more elements>" and similar wording, where the list of two or more elements are joined by "and" or "or", mean at least any one of the elements, or at least any two or more of the elements, or at least all the elements. For example, the phrases "at least one of A and B" and "at least one of A or B" are both to be interpreted to have the same meaning, encompassing the following three possibilities: 1—only A; 2—only B; 3—both A and B.

The embodiments covered by the claims in this application are limited to embodiments that (1) are enabled by this specification and (2) correspond to statutory subject matter. Non-enabled embodiments and embodiments that correspond to non-statutory subject matter are explicitly disclaimed even if they fall within the scope of the claims.

While preferred embodiments of the disclosure have been shown and described herein, it will be obvious to those skilled in the art that such embodiments are provided by way of example only. Numerous variations, changes, and substitutions will now occur to those skilled in the art without departing from the disclosure. It should be understood that various alternatives to the embodiments of the disclosure described herein may be employed in practicing the technology of the disclosure. It is intended that the following claims define the scope of the invention and that methods and structures within the scope of these claims and their equivalents be covered thereby.

What is claimed is:

1. An exercise device comprising:
a base;
an insert slidably coupled within the base;
a compression element located within a cavity formed by the base and the insert;
an extension element extending through the cavity; and
opposing handles connected to opposing ends of the extension element, wherein:
the compression element is compressed when the opposing handles are moved closer together;
the extension element is extended when the opposing handles are moved further apart;
in an equilibrium state of the device with no external longitudinal forces applied to the handles, the compression element is partially compressed and the extension element is partially extended;
(i) opposing ends of the extension element are connected to the handles, but (ii) opposing ends of the compression element are not connected to the handles, such that:
when the handles are moved farther apart from the device's equilibrium state, the extension element is further extended, but the compression element is not relaxed; and
when the handles are moved closer together from the device's equilibrium state, the extension element is relaxed and the compression element is further compressed.

2. The device of claim 1, wherein:
the compression element comprises a helical spring; and
the extension element comprises an elastic band.

3. The device of claim 1, wherein the insert has one or more keys that engage one or more keyways of the base such that, when the one or more keys are fully engaged within the one or more keyways, the compression element is partially compressed to exert outward translational forces to the insert and the base that keep the insert and the base interconnected when no external translational forces are applied to the insert and the base.

4. The device of claim 1, wherein opposing ends of the extension element are connected to the handles by crimp assemblies located between the handle and a corresponding collar.

5. The device of claim 4, wherein each crimp assembly comprises a female crimp element that mates with a male crimp element to secure the corresponding end of the extension element.

6. The device of claim 1, wherein the handles are replaceable by handles of different size and/or shape.

7. The device of claim 1, wherein:
the compression element comprises a helical spring;
the extension element comprises an elastic band;
the insert has one or more keys that engage one or more keyways of the base such that, when the one or more keys are fully engaged within the one or more keyways, the spring is partially compressed to exert outward translational forces to the insert and the base that keep the insert and the base interconnected when no external translational forces are applied to the insert and the base;
opposing ends of the elastic band are connected to the handles by crimp assemblies located between the handle and a corresponding collar;
each crimp assembly comprises a female crimp element that mates with a male crimp element to secure the corresponding end of the elastic band; and
the handles are replaceable by other handles of different size and/or shape.

8. An exercise device comprising:
a base;
an insert slidably coupled within the base;
a compression element located within a cavity formed by the base and the insert;
an extension element extending through the cavity; and
opposing handles connected to opposing ends of the extension element, wherein:
the compression element is compressed when the opposing handles are moved closer together;
the extension element is extended when the opposing handles are moved further apart;
in an equilibrium state of the device with no external longitudinal forces applied to the handles, the compression element is partially compressed and the extension element is partially extended; and
the insert has one or more keys that engage one or more keyways of the base such that, when the one or more keys are fully engaged within the one or more keyways, the compression element is partially compressed to exert outward translational forces to the insert and the base that keep the insert and the base interconnected when no external translational forces are applied to the insert and the base.

9. The device of claim 8, wherein:

the compression element comprises a helical spring; and the extension element comprises an elastic band.

10. The device of claim 8, wherein the handles are replaceable by handles of different size and/or shape.

11. An exercise device comprising:

a base;

an insert slidably coupled within the base;

a compression element located within a cavity formed by the base and the insert;

an extension element extending through the cavity; and opposing handles connected to opposing ends of the extension element, wherein:

the compression element is compressed when the opposing handles are moved closer together;

the extension element is extended when the opposing handles are moved further apart;

in an equilibrium state of the device with no external longitudinal forces applied to the handles, the compression element is partially compressed and the extension element is partially extended; and opposing ends of the extension element are connected to the handles by crimp assemblies located between the handle and a corresponding collar.

12. The device of claim 11, wherein each crimp assembly comprises a female crimp element that mates with a male crimp element to secure the corresponding end of the extension element.

13. The device of claim 11, wherein:

the compression element comprises a helical spring; and the extension element comprises an elastic band.

14. The device of claim 11, wherein the handles are replaceable by handles of different size and/or shape.

* * * * *